US006926213B2

(12) United States Patent
Coles

(10) Patent No.: US 6,926,213 B2
(45) **Date of Patent: *Aug. 9, 2005**

(54) POWER WASHER WAND

(75) Inventor: Charles Coles, 25 Hollywood Ave., Massapequa, NY (US) 11758

(73) Assignee: Charles Coles, Massapequa, NY (US)

( * ) Notice: Subject to any disclaimer, the term of this patent is extended or adjusted under 35 U.S.C. 154(b) by 356 days.

This patent is subject to a terminal disclaimer.

(21) Appl. No.: 10/080,531

(22) Filed: Feb. 22, 2002

(65) Prior Publication Data

US 2002/0166906 A1 Nov. 14, 2002

Related U.S. Application Data

(63) Continuation-in-part of application No. 10/060,040, filed on Jan. 29, 2002, now abandoned, which is a continuation of application No. 09/694,462, filed on Oct. 23, 2000, now Pat. No. 6,341,738, which is a continuation of application No. 08/914,311, filed on Aug. 18, 1997, now Pat. No. 6,158,677.

(51) Int. Cl.[7] ..... B05B 7/02

(52) U.S. Cl. ..... 239/526; 239/530; 239/587.1; 239/525

(58) Field of Search ..... 239/302, 337, 239/447, 525, 526, 530, 532, 456, 458, 588, 270, 280, 587.1, 587.2, 587.3, 587.5; 138/11, 26, 177, DIG. 11

(56) References Cited

U.S. PATENT DOCUMENTS

| | | | | |
|---|---|---|---|---|
| 1,779,177 A | | 10/1930 | Long | |
| 2,067,044 A | * | 1/1937 | Corley | 285/61 |
| 2,464,366 A | | 3/1949 | Bakke | |
| 2,998,199 A | * | 8/1961 | Miscovich | 239/587.2 |
| 3,023,971 A | | 3/1962 | Milhous | |
| 3,410,493 A | | 11/1968 | Dion-Biro | |
| 3,940,072 A | | 2/1976 | Ishikawa | |
| 4,043,397 A | | 8/1977 | Glowienke | |
| 4,216,911 A | | 8/1980 | Huperz | |
| 4,570,854 A | | 2/1986 | Wernahrt | |
| 4,607,702 A | * | 8/1986 | Miller | 169/25 |
| 4,674,686 A | * | 6/1987 | Trapp | 239/279 |
| 4,915,419 A | | 4/1990 | Smith, III | |
| 5,725,322 A | | 3/1998 | Evans | |
| 5,749,526 A | | 5/1998 | Laabs et al. | |
| 5,897,061 A | | 4/1999 | Petty | |
| 5,947,388 A | | 9/1999 | Woodruff | |
| 6,158,677 A | * | 12/2000 | Coles | 239/526 |
| 6,164,570 A | | 12/2000 | Smeltzer | |

OTHER PUBLICATIONS

Kurtz Manufacturing, Inc. Brochure, pp. 7–8, "Telescopic Wands" and "Extension Wand Kit" , date unknown.

Water Cannon Product Catalog, p. 5, "Telescopic Wand" , date unknown.

The Fire Chief's Handbook, pp. 332–333, 344–345, and 348–349, date unknown.

* cited by examiner

*Primary Examiner*—Dinh Q. Nguyen
(74) *Attorney, Agent, or Firm*—Proskauer Rose LLP

(57) ABSTRACT

A power washer wand has a configuration which balances the forces of the water stream. By balancing these forces, the back pressure is greatly reduced. This results in less fatigue for the user and also enables the wand to be extended in order to reach high or distant surfaces without the use of a ladder or scaffold. The wand includes an angle changing coupling such as a swivel joint which allows the angle between the configuration that balances the forces ("force balancing configuration") and the surface being washed to remain substantially constant. The angle changing coupling is preferably located at the proximal end of the force balancing configuration. In one version, the force balancing configuration is a loop or helix having a the first bend replaced with an angle changing coupling or a right angle fitting. In a second version, the force balancing configuration is a two-tined, fork-shaped divergent configuration which reconverges at a distal coupling, such as a "Y" coupling. An angle changing coupling is located at a proximal end to the divergent configuration. The wand may be longer than conventional wands and may be connected to an extension.

29 Claims, 7 Drawing Sheets

POWER WASHER WAND

RELATED APPLICATIONS

This application is a continuation-in-part of application Ser. No. 10/060,040, filed Jan. 29, 2002, now abandoned, which is a continuation of application Ser. No. 09/694,462, filed Oct. 23, 2000, now U.S. Pat. No. 6,341,738, issued Jan. 29, 2002, which is a continuation of application Ser. No. 08/914,311, filed Aug. 18, 1997, now U.S. Pat. No. 6,158, 677, issued Dec. 12, 2000. The content of all of these patents and patent applications is incorporated herein by reference as if set out below in full.

BACKGROUND OF THE INVENTION

1. Field of the Invention

The present invention relates to an improved power washer wand and, more particularly, to a power washer wand having a configuration that greatly reduces the back pressure exerted on the user.

2. Discussion of Related Art

Power washing, or pressure washing, is commonly used in the maintenance of buildings and other exterior surfaces. Power washing is typically performed using a device such as is seen in FIG. 1. A power washing machine 100 typically includes a pump 107 connected to a water source 109, and a wand 111 which is connected to the pump 107 by a hose 113. The power washer user holds the power washer wand 111 and activates a trigger 115 to expel from a nozzle or tip 117 a highly pressurized water stream against a surface. This highly pressurized water stream is typically used to remove dirt, mildew, and other unwanted substances from a surface.

One well-known drawback of power washing is the back pressure exerted from the highly pressurized water stream to the user. This back pressure has several drawbacks.

A first drawback is that the back pressure prevents the user from standing on the ground and extending his arms to reach high or distant surfaces. The pressure exerted from the surface and through the wand increases exponentially as it extends down a straight line. If a user extends his arm to wash a distant surface, the force from the water against the surface to the user's shoulder is much greater than, for example, the force from the surface to the user's elbow. Note that the pressure of the water stream against the surface may exceed 2000 lb/in$^2$ and the distance from the surface to the user's shoulder (i.e., with arm extended) may exceed 6 feet. Thus, the pressure exerted on the user's shoulder may be great. Consequently, the user may need to erect a scaffold or ladder from which distant surfaces may be reached without the user extending his arm. This is inconvenient, time consuming, and expensive especially if a ladder or scaffold is not readily available. Moreover, this is dangerous. The back pressure exerted by the water stream may cause the user to fall from the ladder or scaffold. In some cases, some surfaces may not be reached even if a ladder or scaffold is used.

A second drawback is that the back pressure limits the size of the wand. Because the straight length from the surface through a straight line exponentially increases the force on the user, a long wand is difficult to operate. Thus, a wand for use with a high pressure nozzle cannot be made longer than several feet because the pressure from the surface being power washed to the user's elbow (or even to the trigger) is too great for convenient and safe use. Similarly, a wand for use with a high pressure nozzle cannot be connected to an extension, again because the forces on the user holding the proximal end of the wand/extension combination are too great.

As shown in FIG. 1, a typical wand 111 is connected to the hose 113 using a conventional "quick coupler" 119. If an extended wand was constructed of a number of portions connected using only conventional quick couplings, the extension would not be safe. This is because the back pressure exerted on the couplings would greatly stress the couplings and could result in the extension breaking during use. This effect make the power washer unwieldy and not easily maneuverable. This results in an inadequate washing of the distant surfaces. Another known wand is a telescopic wand. However, telescopic wands are intended for use only with low pressure nozzles. For example, a low pressure nozzle may have a 25° "fan out." As seen in FIG. 2A, a tip 117' having a large "fan out" distributes the water W along a large area of the surface being cleaned. As a result, the pressure against the surface is reduced. At the same time, the effectiveness of the power washer to remove unwanted substances from the surface is also reduced. On the other hand, as seen in FIG. 2B, nozzles having little or no "fan out," such as a 0° nozzle 117", focus all of the water stream's pressure on a small area of the surface being cleaned and thus are more effective at removing unwanted substances from the surface. For the reasons described above, however, a telescopic wand cannot be used practically with a high pressure nozzle.

A third drawback is that the back pressure tends to fatigue the user because the user exerts energy against this back pressure in order to hold the wand 111 steady during use.

U.S. Pat. No. 6,158,677, invented by the present inventor, discloses a power washer wand, one embodiment of which is shown in FIGS. 3A and 3B. In the embodiment shown in FIGS. 3A and 3B, a power washer wand 320 has a quick coupling 322 which detachably connects the wand to a hose 324. The embodiment of the power washer wand 320 shown in FIG. 3A also has a trigger 326 of the conventional type. Located between the trigger 326 and the nozzle or tip 328 of this wand is a loop or helix 330. Preferably, the loop 330 is located at a position which is slightly proximal from the nozzle, such as between several inches to a foot behind the nozzle 328.

The loop 330 preferably has a turn which brings the water stream back over itself. Most preferably, the turn is 270°. To reduce any problems in handling the power washer wand, it is preferable to reduce the diameter of the loop to be as small as possible. Due to current limitations in the fabrication process, the diameter of the loop in a commercial embodiment is approximately 3 inches. The inventor believes that this loop 330 balances the vector forces caused by the pressurized water stream against the surface being power washed.

Referring to FIG. 3A, the wand may optionally be provided with a standard swivel joint 332 (referred to as a universal joint in the previous applications). In the embodiment illustrated in FIG. 3A, the swivel joint 332 is located proximal to the nozzle 328 and distal to the loop 330. The standard swivel joint is a well-known coupling that connects two elements, in this case pipes, allowing freedom of movement in at least one plane. This swivel joint 332 therefore permits the wand nozzle 328 to be adjusted to a desired angle. The movement of the nozzle is illustrated by the dashed lines in FIG. 3A. It was found that during use of the inventive wand, if the angle between the wand nozzle 328 and the surface being washed fell outside of a desired range of angles between about 0° and 45° with respect to horizontal, the back pressure was no longer reduced. Thus, the swivel joint 332 is provided to maintain the desired range of angles between the wand nozzle 328 and the surface being washed.

A drawback to the power washer wand disclosed in U.S. Pat. No. 6,158,677 is the expense in producing the loop 330, shown in FIG. 3A. A commercial embodiment of the loop, shown in FIG. 3B, is manufactured in four bending steps. To manufacture the commercial embodiment of the loop shown in FIG. 3A, a single piece of metal, such as ½ inch diameter iron pipe or steel tubing, or other suitable material, is bent into a loop with a mechanical bend of over 180°, such as loop 330 as shown in FIG. 3B, which typically requires four bending steps. A die is typically needed for each bend, and each bend involves a separate bending step. The loop 330, illustrated in FIG. 3B, comprises a first bend 331 which is a 45° bend, a second bend 333, which is a semicircular bend of approximately 190°, and a third bend 335 which is a 45° bend. The first bend 331 is typically produced using one die and one bending step. The second bend 333 is typically produced using one die and two bending steps. Two bending steps are performed because as noted above, a bend of over 180° is difficult to produce. Therefore, a 180° bending step is first performed on the material, and then the material is adjusted and a further bending step is performed in the material resulting in the 190° bend 335. The third bend 335 is produced in the same manner as the first bend, using one die and one bending step. Therefore, a commercial embodiment of the loop 330, as illustrated in FIG. 3B, is produced using two different dies and four different bending steps. The bending steps can be performed, for example, on a Hossfeld Universal® Bender, manufactured by Hossfeld Mfg. Co. of Winona, Minn. Thus, manufacturing a loop 330 as illustrated in FIGS. 3A and 3B, will typically require two different dies and four bending steps. These multiple dies and multiple bending steps increase the manufacturing cost of the wand.

It is therefore an object of the present invention to provide a power washer wand which reduces the back pressure caused by the water stream.

It is a further object of the present invention to provide a power washer which may be used to reach distant surfaces without the use of a scaffold or ladder.

It is yet a further object of the present invention to provide a power washer wand which may have an extended length without any compromise in nozzle pressure.

It is an even further object of the present invention to provide an improved extended wand.

It is still a further object of the present invention to provide a power washer wand which is inexpensive to manufacture.

SUMMARY OF THE INVENTION

These and other objects of the present invention are provided by a power washer wand having a configuration that balances the forces of the water stream. By balancing these forces, the back pressure is greatly reduced. This results in less fatigue for the user and also enables the wand to be extended in order to reach high or distant surfaces without the use of a ladder or scaffold.

The wand may preferably include an angle changing coupling, such as a swivel joint, that allows the angle between the configuration that balances the forces ("force balancing configuration") and the surface being washed to remain substantially constant. The angle changing coupling is preferably located at the proximal end of the force balancing configuration, e.g., at or upstream of any bend or diversion in the pressurized stream.

In one preferred embodiment, the first "bend" in a force balancing configuration such as a loop or helix comprises an angle changing coupling and/or a right angle fitting. This reduces the number of bending steps performed on a single piece of material, thus being economical to manufacture.

In another preferred embodiment, the force balancing configuration is a two-tined, fork-shaped divergent configuration in which the tines reconverge at a distal coupling, such as a "Y" coupling. Each tine of the "fork" preferably has a bend that is less than 180° so that there is no need to perform more than one bending step on a single piece of material, and is therefore economical to produce. Preferably, the same die may be used to perform the bending steps on both tines. The wand may also preferably include an angle changing coupling. In both embodiments, the wand may be longer than conventional wands and may be connected to an extension without compromising of nozzle pressure.

BRIEF DESCRIPTION OF THE DRAWINGS

The present invention is described with reference to the following figures.

DETAILED DESCRIPTION OF PREFERRED EMBODIMENTS

Figure 4A:
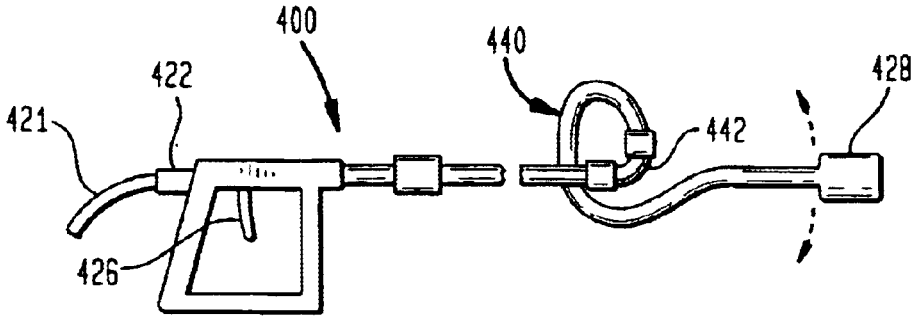
FIG. 4A is a side elevational view of a power washer wand according to a first preferred embodiment of the present invention.
Figure 4B:
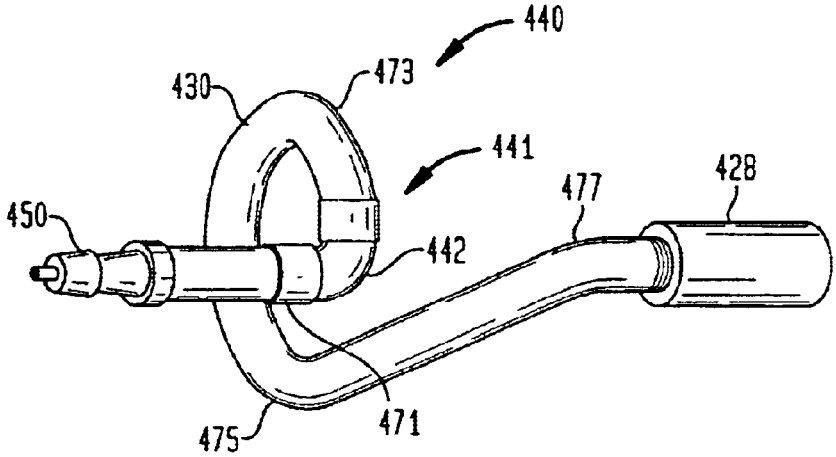
FIG. 4B is a side elevational view of the force balancing configuration and nozzle of the power washer according to the first preferred embodiment of the present invention wherein the force balancing configuration is a loop or helix.

FIGS. 4A and 4B illustrate a first preferred embodiment of a power washer wand 400 according to the present invention. The power washer wand 400 of FIGS. 4A and 4B preferably has a quick coupling 422 which detachably connects the wand 400 to a hose 424 at one end. At the other end of the wand 400 is preferably a female coupler 428 for detachably connecting various spray tips from which the pressurized water stream is expelled. The power washer 400 also preferably has a trigger 426 of the conventional type. Located between the trigger 426 and the female coupler 428 is a force balancing configuration 440. Preferably, the force balancing configuration 440 is located at a position which is slightly proximal from the nozzle, such as between several inches to a foot behind the nozzle 428.

In accordance with this first embodiment of the present invention, the force balancing configuration 440 preferably has a turn which brings the water stream back over itself. Most preferably, the turn is 270°. The inventor believes that this force balancing configuration 440 balances the vector forces caused by the pressurized water stream against the surface being power washed. The inventor has found that this embodiment is the most effective in reducing the back pressure caused by the water stream and can be easily used to reach and clean distance surfaces.

Referring to the embodiment illustrated in FIG. 4A, the wand 400 may also be provided with an angle changing coupling 442. The angle changing coupling 442 permits the force balancing configuration 440 and female coupler 428 to be adjusted to a desired angle with respect to a surface being washed. The angle changing coupling 442 may be a swivel joint, such as a 90° Swivel Adapter available from Northern Tool and Equipment of Burnsville, Minn., or other suitable device. The 90° Swivel Adapter is constructed of steel and is able to withstand 10,000 lbs./in$^2$ of pressure. The movement of the nozzle is illustrated by the dashed lines in FIG. 4A.

Figure 3A:
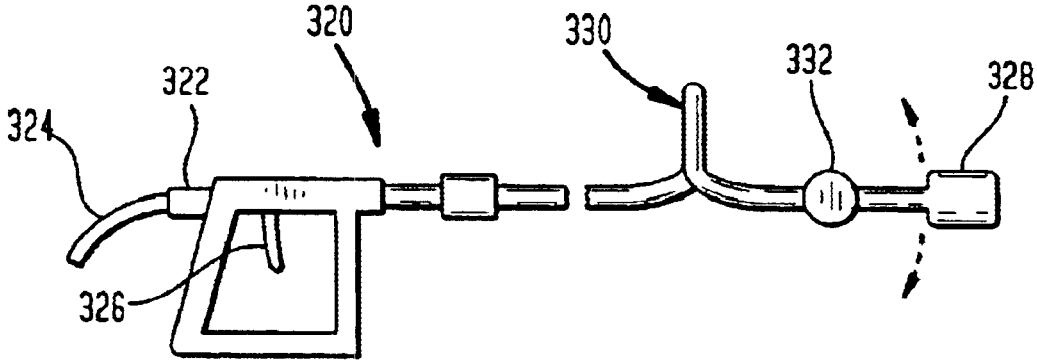
FIG. 3A is a side elevational view of an embodiment of a power washer wand having a loop as described in U.S. Pat. No. 6,158,677.
Figure 3B:
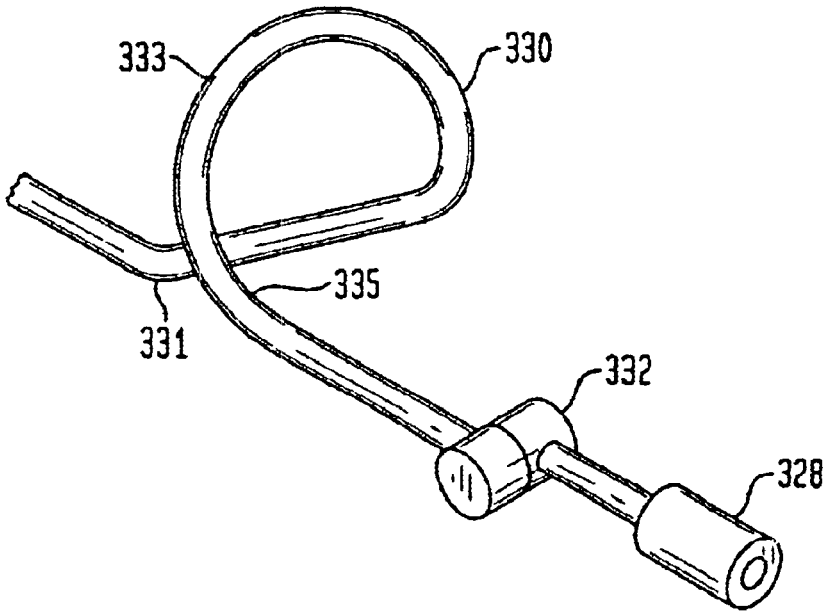
FIG. 3B is an isometric view of the loop of FIG. 3A.
Figure 4C:
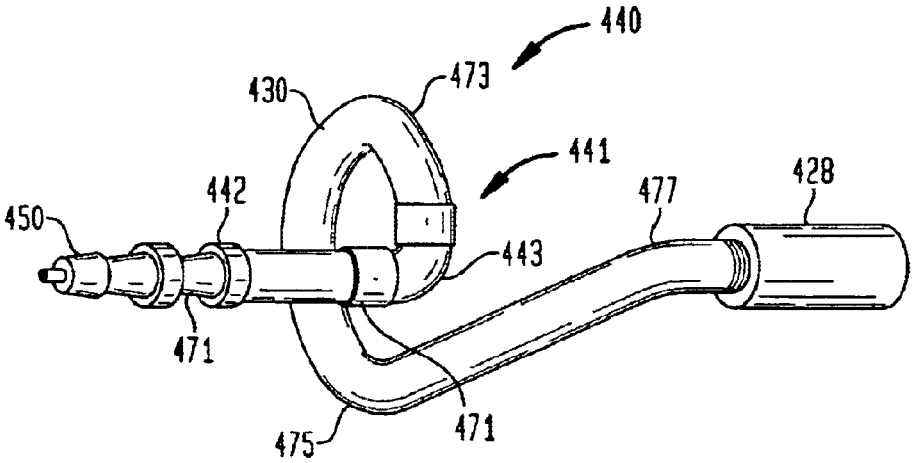
FIG. 4C is a side elevational view of the force balancing configuration and nozzle of the power washer according to the first preferred embodiment of the present invention wherein the force balancing configuration is a loop or helix and wherein the first bend comprises a right angle fitting.

In the embodiment seen in FIGS. 4A, 4B, and 4C, the force balancing configuration 440 is a loop or helix. A reduction in the number of bending steps in the manufacture of this force balancing configuration may be achieved by replacing the first (proximal) bend 441 with an angle changing coupling 442, as seen in FIG. 4B, or a right angle fitting 443, as seen in FIG. 4C. The first bend 441 and loop 430 shown in FIGS. 4B and 4C are analogous to the first bend 331 and loop 330 shown in FIG. 3B, respectively. As noted above, a bend of over 190° typically requires more than one bending step to be performed on a single piece of material, and may require the use of more than one die to produce the desired bend in a single piece of material. Since in a preferred embodiment, the bend in the force balancing configuration 440 is 270°, the angle changing coupling 442 (FIG. 4B) or the right angle fitting 443 (FIG. 4C) takes the place of the first bend 441, the manufacturing process involves only one bend of less than 190°. The angle changing coupling, which may be a 90° swivel adapter, or the right angle fitting in the place of the proximal bend in the loop has been found to be less expensive and easier to produce than machining a 270° bend in a single piece of material.

Figure 1:
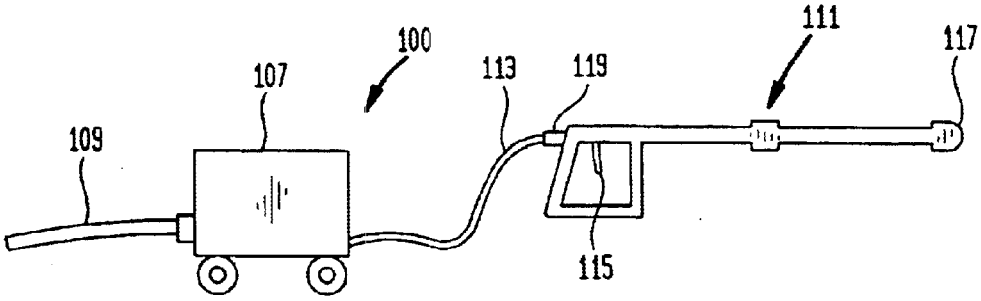
FIG. 1 (PRIOR ART)
FIG. 1 illustrates a conventional power washing apparatus.
Figure 2A:
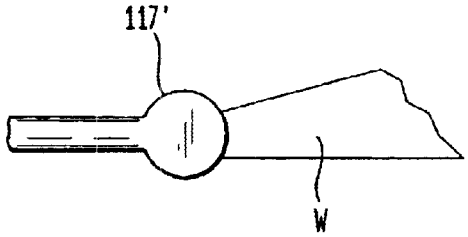
FIG. 2A (PRIOR ART)
FIG. 2A illustrates a power washer nozzle having reduced pressure against a surface due to a "fan out"
Figure 2B:
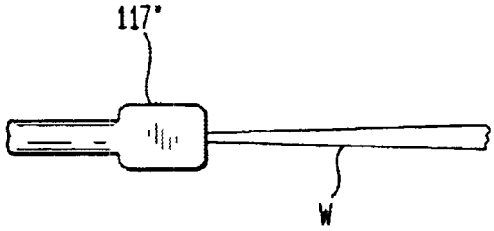
FIG. 2B (PRIOR ART)
FIG. 2B illustrates a power washer nozzle having no "fan out"
Figure 7:
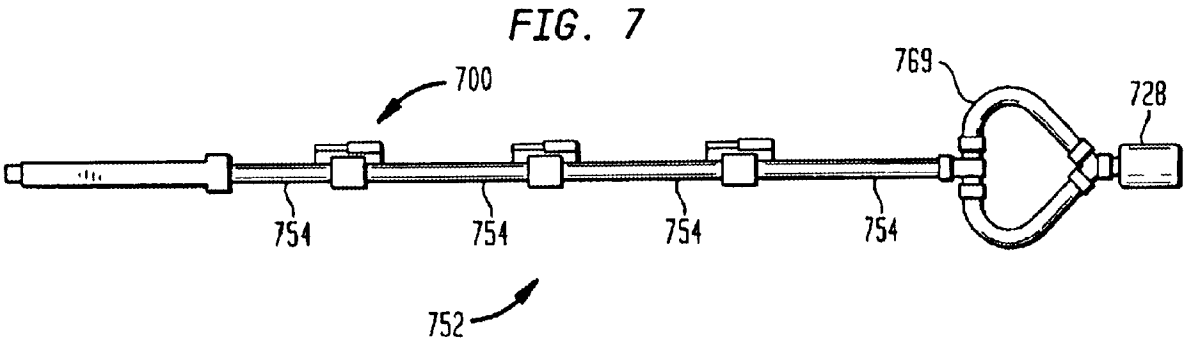
FIG. 7 is a top view of a power washer wand according to the second preferred embodiment of the present invention wherein the wand has an extended length.

The force balancing configuration 440 may be constructed using conventional materials and methods. A preferred embodiment of the configuration 440 may be constructed from conventional hydraulic tubing, such as steel hydraulic tubing having a ½" diameter and able to withstand 4,000 lbs/in$^2$ pressure, and conventional hydraulic fittings, able to withstand 10,000 lbs/in$^2$ pressure, and produced using conventional processes. These components may be found in plumbing and hardware stores. In one commercial embodiment of the invention, a standard male coupler 450 detachably connects the wand to a hose (seen as reference numeral 109 in FIG. 1). The male coupler 450 may be sweat fitted in the conventional manner to a first length of hydraulic tubing 471. An angle changing device 442, such as a swivel joint, may then be threaded on one end to the length of tubing 471. The swivel joint 442 may be a 90° swivel adapter known and used in high pressure fluid applications. As shown in FIG. 4B, the swivel joint 442 may then be threaded on a second end to a second length of tubing 473. In an alternate embodiment shown in FIG. 4C, the second end of the swivel joint may be threaded to a first end of an intermediate short length of tubing 471'. The second end of the intermediate short length of tubing 471' may then be threaded into a first end of a standard right angle fitting 443. A second end of the right angle fitting 443 may then be threaded into a second length of tubing 473. This length of tubing 473 has a bend of preferably 180°. Second and third bends, 475, 477, each preferably 45°, are then formed in the length of tubing 473 to axially align it with the first length of tubing 471. This axial alignment is best seen in FIG. 7, where connected portion 754 is axially aligned with the female coupler 728. The second length of tubing 473 may then be threaded into a female coupler 428.

The force balancing configuration 440, such as the helix shown in FIGS. 4A–4C, may also be constructed using conventional processes. Typically, a die is used for each bend to be made in the material and a separate bending step is employed for each bend. The angle changing coupling 442, or the right angle fitting 443, comprises the first bend 441 in the force balancing configuration 440 thereby using only three bending steps to be performed on the material. As noted above, a typical loop, having two 45° bends, and a semicircular bend of approximately 190°, may use two dies and four bending steps to achieve the desired shape. The force balancing configuration 440 may be formed using only two dies and three bending steps. The first bend 473 is preferably 180°, which may be produced, for example on a Hossfeld Universal® Bender, using one die and one bending step. The second and third bends, 475, 477, may be produced using a second die and one bending step each. It is therefore economical to produce the force balancing configuration 440 in accordance with the present invention.

Figure 5:
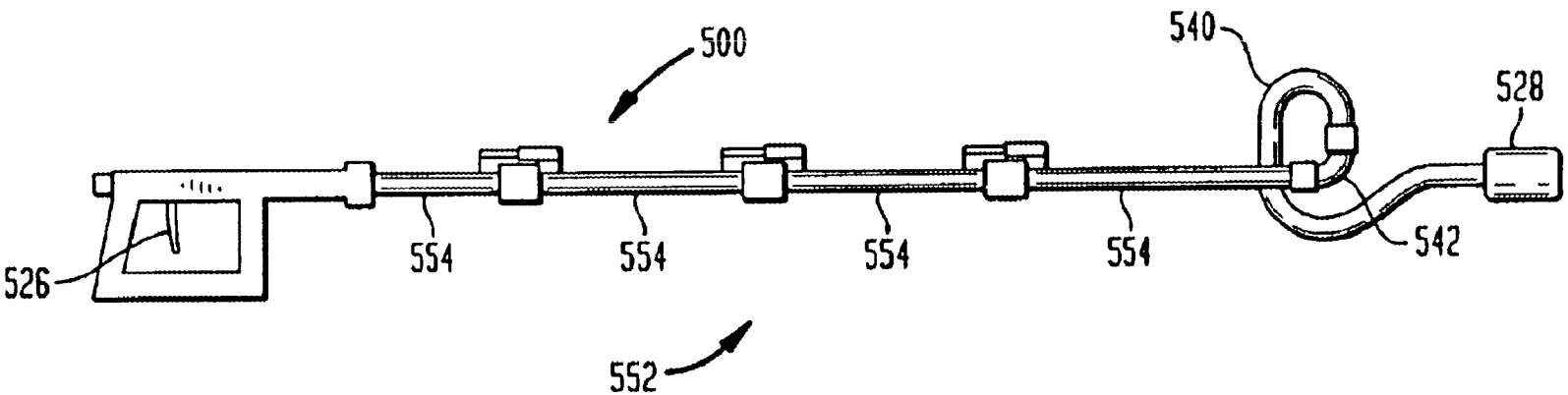
FIG. 5 illustrates a power washer wand according to the first preferred embodiment of the present invention wherein the wand has an extended length.

The reduction in back pressure achieved by the inventive wand permits a power washer wand 500 having an extended length without compromising nozzle pressure. In FIG. 5, the force balancing configuration 540 may be included in an extension wand 552 which may detachably connect to a trigger 526 or to the end of a conventional wand (111 in FIG. 1) at one end and to a female coupler or nozzle 528 at a second end. The force balancing configuration 540, in accordance with a first embodiment of the present invention has an angle changing coupling 542, or right angle fitting preferably in conjunction with an angle changing coupling upstream, located at a proximal end of the force balancing configuration 540, e.g., at or upstream of any bend or redirection of the pressurized stream. This force balancing configuration is analogous to the force balancing configuration 440 shown in FIGS. 4A–4C. The extension wand 552 may comprise a number of connected portions 554. This extended wand permits a user to reach distant surfaces with a much more powerful tip than was previously possible. The present invention may reach surfaces which previously could only be reached using a ladder or scaffold and surfaces which may not have been accessible even with a ladder or scaffold.

Figure 6:
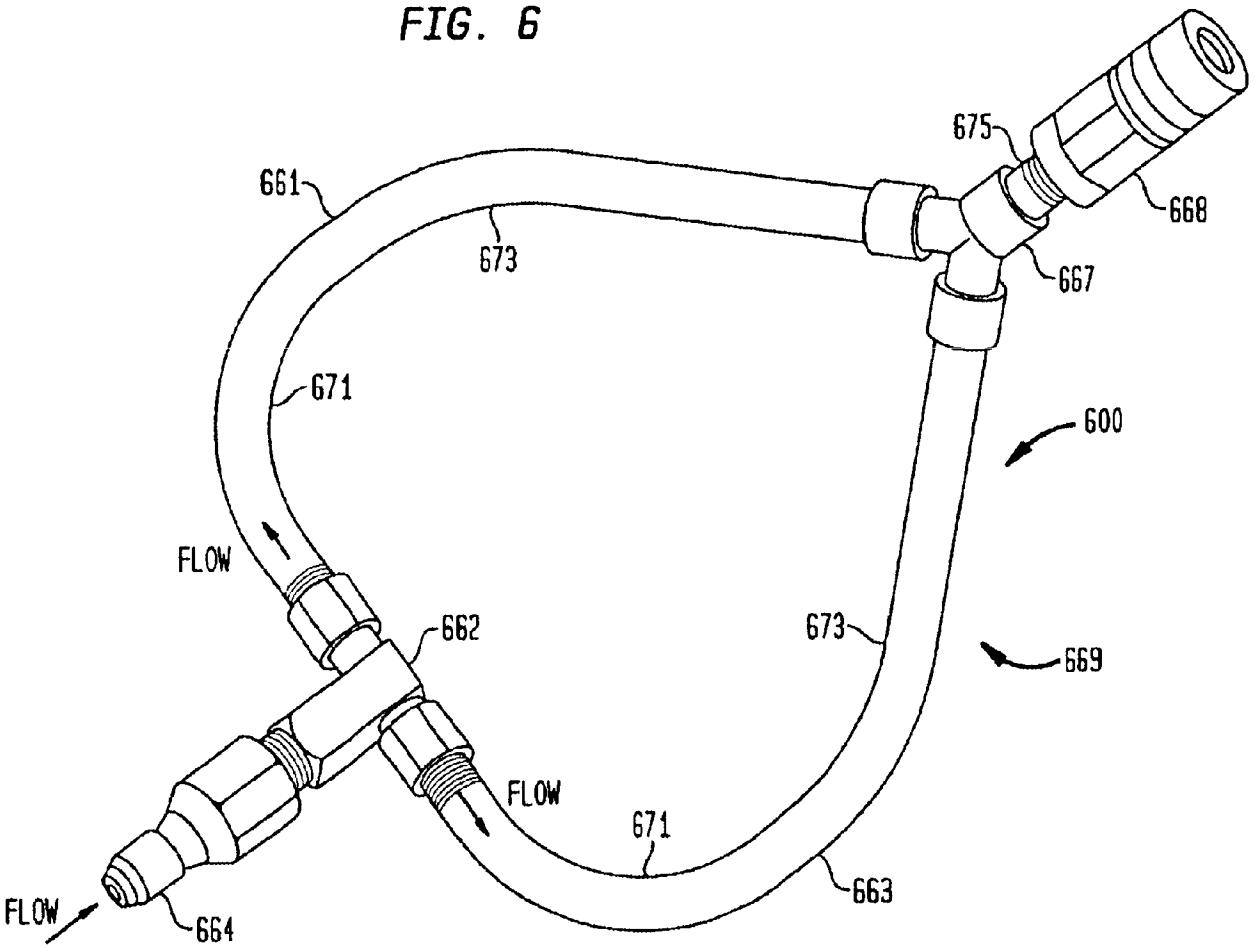
FIG. 6 is an isometric view of a force balancing configuration and nozzle of a power washer wand according to a second preferred embodiment of the present invention where the force balancing configuration is a two-tined, fork-shaped configuration.

FIG. 6 shows another preferred embodiment of the present invention. The power washer wand 600 preferably has a male coupler 664 at one end which detachably connects the wand to a hose (seen as reference numeral 109 in FIG. 1). Located at the other end of the wand 600 is preferably a female coupler 668 for detachably connecting various spray tips from which the pressurized stream of water is expelled. Located between the male coupler 664 and the female coupler 668 is a force balancing configuration 669 comprising two branches 661, 663. The branches 661, 663 are preferably substantially identical in construction and are arranged parallel to one another. The branches 661, 663 are connected to the male coupler 664 preferably by a T-shaped joint 662, and reconverge at a distal coupling 667, such as a "Y" coupling (sometimes referred to as a "double 45° coupler"), connected to the female coupler 668. Preferably, the T-shaped joint 662 is an angle changing coupling that permits the force balancing configuration 669 and female coupler 668 to be adjusted to a desired angle with respect to a surface being washed. The angle changing coupling 662 may be a T-shaped swivel joint, such as a Swivel Branch Tee joint available from Northern Tool and Equipment of Burnsville, N. Mex., or other suitable device. The Swivel Branch Tee joint is constructed of steel and is able to withstand 10,000 lbs./in$^2$ of pressure. The force balancing configuration 669, comprising the branches 661, 663, may be generally fork-shaped with two "tines" (branches 661, 663) which diverge from the T-shaped joint 662, which preferably is an angle changing coupling, and reconverge at the distal coupling 667, such as a "Y" coupling. The angle changing coupling 662, if present, is preferably located at or upstream of the branches 661, 663; i.e., before the pressurized stream is split into two approximately identical components within the branches.

In a preferred embodiment of the invention, illustrated in FIG. 6, each of the branches 661, 663 contains a bend of less than 190°. Preferably, each branch 661, 663 comprises a first bend 671, which is preferably a 90° bend, followed by a second bend 673, which is preferably a 45° bend. As previously mentioned, a bend exceeding 190° may be difficult and expensive to manufacture. Because of the placement of the T-shaped joint 662, preferably a Swivel Branch Tee joint, at the proximal end of the bend in the branches 661, 663, a bend of over 190° in the material is not required. Preferably, the two branches 661, 663 are configured so that the same die may be used to perform the bending steps on both branches 661, 663. A first bend 671 is produced using one die and one bending step. The second bend 673 is produced using the same die and a second bending step. The power washer wand 600 shown in FIG. 6 has therefore been found to be economical to manufacture. As previously mentioned, it was found that during use of the inventive wand, if the angle between the force balancing configuration 669 and the surface being washed fell outside of a desired range of angles between about 0° and 45° with respect to horizontal, the back pressure was no longer reduced. Thus, the T-shaped swivel joint 662 is provided to maintain the desired range of angles between the force balancing configuration 669 and the surface being washed.

In accordance with the embodiment of the present invention shown in FIG. 6, the pressurized water stream enters the male coupler 664, is parted into two approximately equal streams at the T-shaped swivel joint 662, and flows into the branches 661, 663. The split pressurized water streams are then recombined at the "Y" coupler 667 and a single pressurized water stream is expelled from the female coupler 668. The inventor believes the advantages of the present invention may be realized because the overall straight length of the forces in the plane of the trigger to the tip are interrupted by the vector forces in the force balancing configuration 669. Thus, the force from the stream against the surface being washed is exponentially increased only for the distance from the surface to the distal portion of the force balancing configuration 669.

The inventive force balancing configuration 669 of FIG. 6 may be constructed of conventional materials, much like the force balancing configuration 440 of FIGS. 4A and 4B. The branches 661, 663 may be conventional hydraulic tubing, such as steel hydraulic tubing having a ½" diameter and able to withstand 4,000 lbs/in$^2$ of pressure, or other suitable material. For example, if the connected portions of the wand (754 shown in FIG. 7) are constructed of ½" diameter hydraulic tubing, it is possible to manufacture the branches 661, 663 of hydraulic tubing having a smaller diameter, e.g., ⅜". The T-shaped joint 662 may also be a Swivel Branch Tee joint, as noted above, known and used in high pressure applications. The "Y" coupler 667 may be an oversized "Y" fitting made of brass, or other suitable material, which is standard oversized plumbing fitting which may be custom built to withstand the high pressure exerted by the water streams. A suitable oversized "Y" fitting may be made by using, for example, a ¾" outside diameter brass "Y"-shaped blank, which may be obtained from NIBCO of Elkhart, Ind., which is then drilled with a hole to the correct diameter for receiving the tubing. The male coupler 664 may be threaded to the T-shaped joint 662 (or preferably to a T-shaped swivel joint). The branches 661, 663, may then be threaded to the T-shaped joint 662. The branches 661, 663 reconverge at, and are sweat fitted to, the "Y" coupling 667. A relatively short length of tubing 675 is also sweat fitted to the "Y" coupling at one end. The other end of the tubing 675 may then be threaded into the female coupler 668. In a commercial embodiment of the present invention, the outside diameter of the force-balancing configuration may be approximately 6 inches and the length of the force-balancing configuration may be approximately 11 ½ inches long from the proximal tip of the T-shaped joint 662 (preferably a T-shaped swivel joint) to the distal tip of the "Y" fitting 667. The force balancing configuration 669 shown in FIG. 6 may therefore be economically manufactured using generally available materials and known methods.

It was found during use of the inventive wand that the force balancing configuration 669 and the location of the angle changing coupling 662, i.e., at or upstream of any parting of the pressurized water stream, provided for a stable device with a greatly reduced back pressure. It was found that if the angle between the force balancing configuration 669 and the surface being washed fell outside of a desired range of angles between about 0° and 45° with respect to horizontal, the back pressure was not reduced to a great extent. Thus, the angle changing coupling 662 is provided to maintain the desired range of angles between the force balancing configuration 669 and the surface being washed.

FIG. 7 shows a top view of a power washer wand 700 in accordance with one example of a preferred embodiment of the invention. The power washer wand 700 shown in FIG. 7 is similar to the power washer wand 500 shown in FIG. 5. The extension wand 752 may detachably connect to a trigger (not shown) at one end and to a female coupler 728 at a second end to which spray tips or nozzles may detachably connect to expel the pressurized water stream. The extension wand 752 may also comprise a plurality of connected portions 754. However, in FIG. 7, the wand 700 is provided with the force balancing configuration 769 which is analogous to the configuration 669 shown in FIG. 6. The force balancing configuration 769 is preferably aligned in the horizontal plane. The reduction in back pressure due to the inventive configuration 769 permits a power washer wand 700 to have an extended length without compromising nozzle pressure.

Figure 8A:
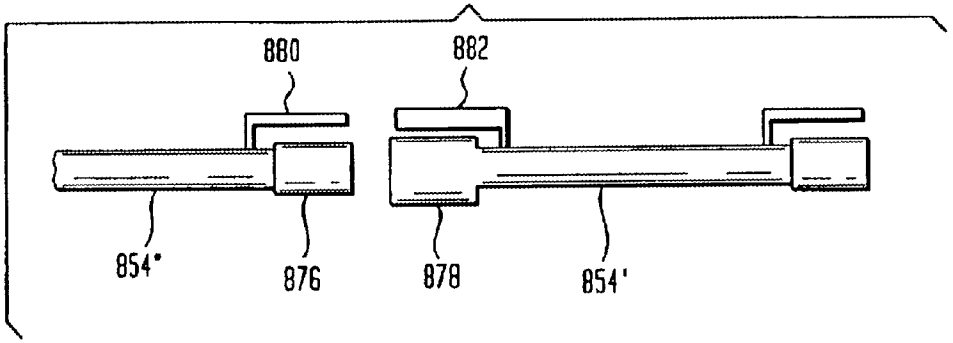
FIG. 8A illustrates two portions of a power washer wand extension according to one example of a preferred embodiment of the present invention.

FIG. 8A illustrates two portions 854', 854" of a power washer wand extension according to a preferred embodiment of the present invention. Note that the two portions are connected by conventional quick couplers 876, 878. In addition, however, each portion 854', 854" is provided with an external male/female coupler 880, 882. These external couplers preferably have a substantial overlap. The external couplers provide rigidity to the extension as well as align the portions to provide a straight conduit for the water stream. These couplers permit a wand of a desired length to be assembled quickly and easily, yet provide a rigid and straight wand.

Figure 8B:
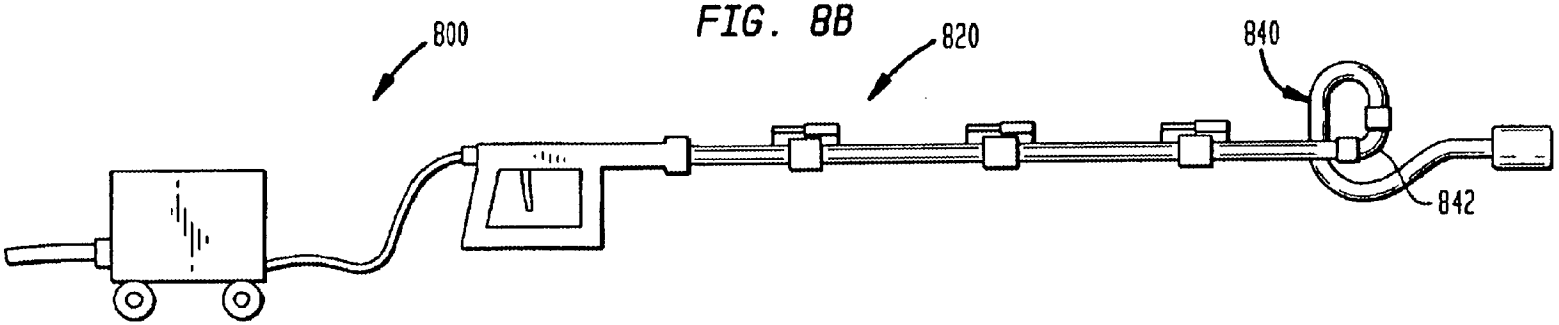
FIG. 8B illustrates a power washer having a wand according to one example of a preferred embodiment of the present invention.

FIG. 8B illustrates a power washer 800 having a wand 820 with a force balancing configuration 840 with an angle changing coupling 842 in accordance with a first embodiment of the present invention. The wand 820 may also have a configuration 669 as shown in FIG. 6, in accordance with a second embodiment of the present invention.

The inventive power washer may be attached to a long extension that may reach, for example, 15–25 feet away from the user. This allows high or distant surfaces, such as second stories of buildings, rooftops, etc. to be easily washed. The inventive wand also permits accurate maneuvering of a high pressure tip (such as 2,400 lbs/in$^2$ at the tip). The inventive power washer wand greatly improves on prior known power washer wands. By reducing the back pressure: (1) the wand may be extended to increase the reach of the wand; (2) the user may extend his arm in order to reach high or distant surfaces; (3) the user operates in greater safety because the user may stand on the ground; and (4) the user is less fatigued. The first two advantages permit power washing distant areas without the aid of a ladder or a scaffold. By eliminating the scaffold and/or ladder, the power washing process becomes significantly less expensive and less time consuming. Even if a ladder or scaffold is used, the present invention is safer to use than a conventional wand, due to the reduced back pressure. Moreover, by remaining on the ground, rather than on a ladder or scaffold, the power washing process becomes significantly safer. Also, an extension allows power washing of surfaces which may be inaccessible even when using a ladder or scaffolding to be reached without loss of cleaning pressure. Yet another advantage is that a power washing job which previously had been performed by more than one person may now be performed by a single person.

It has been found that the power washer wand 400, as shown in FIGS. 4A–4C and in accordance with the first preferred embodiment of the present invention, is very effective in cleaning surfaces, even when the angle of the wand with respect to the surface is greater than 45°.

It has also been found that the power washer wand 600, as shown in FIG. 6 and in accordance with a second preferred embodiment of the present invention, is very balanced and exhibits no torque or rotation during use. It has also been found that this second preferred embodiment of the invention is the least expensive and least difficult to produce of the disclosed embodiments.

The inventor has also noted that the present invention has the following advantages over prior art wands, including the prior known telescopic wands. A power washing job may be completed in less time than when using prior art wands. Moreover, the job is done at a higher quality than when using prior art wands. This is because the user operates at a distance from the surface being cleaned, and this allows the user to view the surface from this distance. Viewing from a distance allows the user to be more "critical" of the thoroughness of the work and allows a more uniform appearance. Thus, a job may be completed in less time and with better results than previously possible with prior art wands. Moreover, ladders and scaffoldings may be avoided. This results in further time and money savings as well as greatly increased safety.

Figure 9:
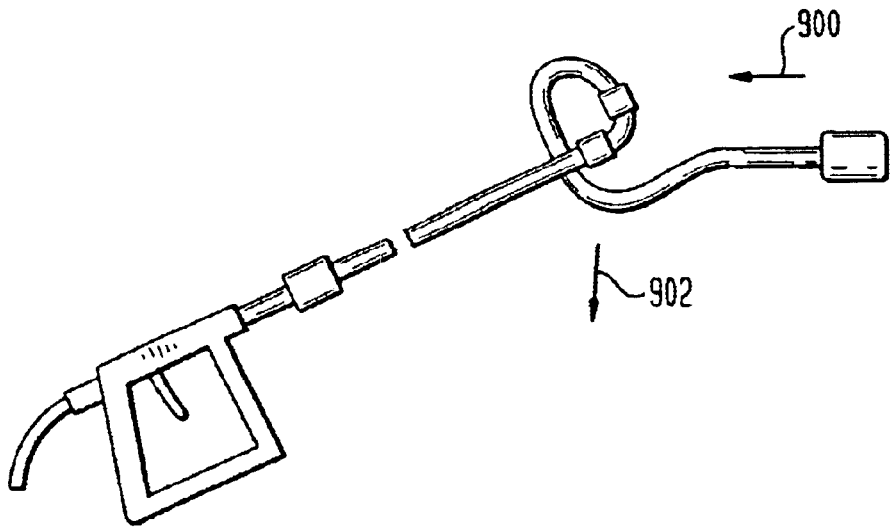
FIG. 9 illustrates how the present invention may neutralize the force experienced by the user due to the weight of the inventive power washer nozzle.

FIG. 9 illustrates how the present invention may reduce or neutralize the force of the weight of the inventive power washer wand experienced by the user. For illustration purposes, FIG. 9 shows the embodiment of the power washer wand shown in FIG. 5. When the nozzle is at an angle with the surface being cleaned, such as at a 45° angle with respect to a surface over the user's head, the back pressure may be reduced due to the forced between the surface, the nozzle and the loop. As seen in the example provided in FIG. 9, the horizontal back pressure 900 may reduce the downward force 902, thus reducing the force experienced by the user due to the weight of the wand.

The above describe embodiments of the invention are intended to be illustrative only. Numerous alternative embodiments may be devised by those skilled in the art without departing from the spirit and scope of the following claims.

I claim:

1. A power washer wand, comprising:

a. a first end configured to receive a pressurized stream;

b. a nozzle configured to expel the pressurized stream;

c. a force balancing configuration located proximal to the nozzle; and d. an angle changing coupling located at a proximal end of the force balancing configuration.

2. The power washer wand of claim 1, wherein the angle changing coupling is configured to change the angle of the force balancing configuration with respect to a surface being washed.

3. The power washer wand of claim 2, wherein the angle changing coupling is configured to allow an angle of the force balancing configuration to remain constant with respect to the surface being washed.

4. The power washer wand of claim 3, wherein the angle changing coupling is a universal joint.

5. The power washer wand of claim 1, wherein the force balancing configuration is a loop.

6. The power washer wand of claim 5, wherein the loop is a 270° loop.

7. The power washer wand of claim 1, wherein the force balancing configuration comprises a diverging configuration with reconvergence at a distal coupling.

8. The power washer wand of claim 7, wherein the diverging configuration is a T-shaped joint and the distal coupling is a "Y" coupling.

9. The power washer wand of claim 1, wherein the first end further comprises a plurality of extension portions, each of the plurality of extension portions having conventional couplings for fluid connection and external couplings configured to provide at least one of rigidity and alignment.

10. The power washer wand of claim 1, wherein the nozzle is a high pressure nozzle.

11. The power washer wand of claim 1, wherein the nozzle has no fan out.

12. The power washer wand of claim 1, wherein the nozzle is a 0° nozzle.

13. An extendable power washer wand, comprising:

a. a first end configured to receive a pressurized stream, the first end having a plurality of extension portions, each of the plurality of extension portions having conventional couplings for fluid connection and external couplings configured to provide at least one of rigidity and alignment;

b. a nozzle configured to expel the pressurized stream;

c. a force balancing configuration located proximal to the nozzle; and d. an angle changing coupling located at a proximal end of the force balancing configuration.

14. The extendable power washer wand of claim 13, wherein the angle changing coupling is configured to change an angle of the force balancing configuration with respect to a surface being washed.

15. The extendable power washer wand of claim 13, wherein the angle changing coupling is configured to allow an angle of the force balancing configuration to remain constant with respect to the surface being washed.

16. The extendable power washer wand of claim 13, wherein the angle changing coupling is a universal joint.

17. The extendable power washer wand of claim 13, wherein the force balancing configuration is a loop.

18. The extendable power washer wand of claim 17, wherein the loop is a 270° loop.

19. The extendable power washer wand of claim 13, wherein the force balancing configuration comprises a diverging configuration with reconvergence at a distal coupling.

20. The extendable power washer wand of claim 19, wherein the diverging configuration is a T-shaped joint and the distal coupling is a "Y" coupling.

21. The extendable power washer wand of claim 13, wherein the nozzle is a high pressure nozzle.

22. The extendable power washer wand of claim 13, wherein the nozzle has no fan out.

23. The extendable power washer wand of claim 13, wherein the nozzle is a 0° nozzle.

24. A power washer, comprising:

a. a pump;

b. a hose connected to the pump; and c. a wand connected to the hose, the wand having:

(1) a first end configured to receive a pressurized stream;

(2) a nozzle configured to receive a pressurized stream;

(3) a force balancing configuration located proximal to the nozzle; and (4) an angle changing coupling located at a proximal end of the force balancing configuration and configured to change an angle of the force balancing configuration with respect to a surface being washed.

25. A power washer wand, comprising:

a. a first end configured to receive a pressurized stream;

b. a nozzle configured to expel the pressurized stream;

c. a loop configured to balance forces from the pressurized stream; and d. an angle changing coupling comprising a proximal bend in the loop configuration and configured to change the angle of the loop with respect to a surface being washed.

26. A power washer wand, comprising:

a. a first end configured to receive a pressurized stream;

b. a nozzle configured to expel the pressurized stream;

c. a loop configured to balance the forces from the pressurized stream; and d. a right angle bend comprising a proximal bend in the loop.

27. The power washer wand of claim 26, further comprising an angle changing coupling located proximal to the right angle bend and configured to change the angle of the loop with respect to a surface being washed.

28. A power washer wand, comprising:

a. a first end configured to receive a pressurized stream;

b. a nozzle configured to expel the pressurized stream; and c. a diverging configuration with reconvergence at a distal coupling configured to balance forces from the pressurized stream.

29. The power washer wand of claim 28, further comprising an angle changing coupling located proximal to the diverging configuration and configured to change the angle of the diverging configuration with respect to a surface being washed.

* * * * *